US009240150B2

(12) United States Patent
Saitoh et al.

(10) Patent No.: US 9,240,150 B2
(45) Date of Patent: Jan. 19, 2016

(54) DISPLAY MODULE, DISPLAY DEVICE, ELECTRONIC EQUIPMENT, AND METHOD FOR DRIVING DISPLAY MODULE

(75) Inventors: Kohji Saitoh, Osaka (JP); Masaki Uehata, Osaka (JP); Masami Ozaki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 70 days.

(21) Appl. No.: 14/126,862

(22) PCT Filed: Jun. 14, 2012

(86) PCT No.: PCT/JP2012/065282

§ 371 (c)(1),
(2), (4) Date: Dec. 17, 2013

(87) PCT Pub. No.: WO2012/176686

PCT Pub. Date: Dec. 27, 2012

(65) Prior Publication Data

US 2014/0118421 A1 May 1, 2014

(30) Foreign Application Priority Data

Jun. 21, 2011 (JP) ..... 2011-137848

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 3/3688* (2013.01); *G09G 3/3666* (2013.01); *G09G 2320/0646* (2013.01); *G09G 2370/08* (2013.01)

(58) Field of Classification Search
CPC ..... G09G 3/3611; G09G 3/3406
See application file for complete search history.

(56) References Cited

U.S. PATENT DOCUMENTS

2009/0027595 A1* 1/2009 Takahashi ..... G09G 3/3611 349/73
2010/0295879 A1* 11/2010 Tanaka ..... G09G 3/3426 345/690

FOREIGN PATENT DOCUMENTS

JP 2009-032714 A 2/2009
JP 2010-160373 A 7/2010
JP 2010-271393 A 12/2010

OTHER PUBLICATIONS

Official Communication issued in International Patent Application No. PCT/JP2012/065282, mailed on Jul. 10, 2012.

*Primary Examiner* — Kumar Patel
*Assistant Examiner* — Sejoon Ahn
(74) *Attorney, Agent, or Firm* — Keating & Bennett, LLP

(57) ABSTRACT

A display module of the present invention includes first through third source drivers (6-1 through 6-3) (i) which are provided for respective regions into which a display region is divided and (ii) each of which includes an analysis circuit and receives a video signal for a corresponding one of the regions but receives no video signal for the regions other than the corresponding one of the regions. The third source driver (6-3) supplies, to the first and second source drivers (6-1 and 6-2), gamma (γ) setting information (19) for generating a source signal to be outputted from each of the first and second source drivers (6-1 and 6-2). The first and second source drivers (6-1 and 6-2) output respective analysis results (5*a* and 5*b*) from the respective analysis circuits. The third source driver (6-3) outputs a PWM signal (14) for controlling the light irradiation section.

10 Claims, 7 Drawing Sheets

DUTY RATIO = ON TIME PERIOD / (ON TIME PERIOD + OFF TIME PERIOD)

DISPLAY MODULE, DISPLAY DEVICE, ELECTRONIC EQUIPMENT, AND METHOD FOR DRIVING DISPLAY MODULE

TECHNICAL FIELD

The present invention relates to (i) a display module including a plurality of source drivers which are provided for respective regions into which a display region is divided, (ii) a display device including the display module, (iii) an electronic device including the display device, and (iv) a method of driving the display module.

BACKGROUND ART

Since most electric power for a display device that is provided with a backlight is consumed by the backlight, power consumption of the display device is reduced by reducing power consumption of the backlight.

Under the circumstances, in recent years, known is a display device which has a CABC (Contents Adaptive Backlight Control) function which controls a backlight in accordance with an image so as to reduce power consumption of the backlight.

For example, as illustrated in FIG. 7, an image display device, disclosed in Patent Literature 1, includes (i) a light modulating value deciding circuit 113 for deciding a light modulating value for a backlight 117 on the basis of an input image signal, (ii) an image signal correcting circuit 120 for correcting, in accordance with a light modulating value, an input image signal to be supplied to a liquid crystal panel 122, and (iii) a backlight driving circuit 116 for controlling driving of the backlight 117 in accordance with a light modulating value. The backlight driving circuit 116 delays timing at which a light modulating value for a current frame is applied, in a case where a luminance of the backlight 117 during the current frame is higher than that of the backlight 117 during the previous frame. This makes it possible to alleviate a deterioration in image quality and reduce power consumption of the backlight 117, even in a case of a rapid change in luminance of an image displayed on the liquid crystal panel 122 while the luminance of the backlight 117 is being controlled.

Further, for example, a conventional configuration, illustrated in FIG. 8, is known. FIG. 8 is an exploded perspective view illustrating a large-sized display device having the conventional configuration. The display device, illustrated in FIG. 8, is a relatively large-sized display device including a plurality of source drivers which enable the display device to display an image in a display region 131 of a liquid crystal panel 125.

Most conventional display devices include a timing controller 123 illustrated in FIG. 8. A typical timing controller (i) receives an externally supplied video signal, (ii) analyzes an image, (iii) generates a control signal (PWM signal) on the basis of a result obtained by analyzing the image, and (iv) supplies the control signal to a backlight driving circuit. The typical timing controller further (i) functions to convert the externally supplied video signal into a signal which allows each source driver to supply a voltage to signal lines with a minimum circuit configuration, and (ii) supplies the signal to the each source driver.

The timing controller 123, which is included in the display device illustrated in FIG. 8, (i) controls timings at which a gate driver 121 and a plurality of source drivers 130-1 through 130-3 are driven, and (ii) supplies pixel data stream to the plurality of source drivers 130-1 through 130-3. The timing controller 123 generates a PWM signal 125, and supplies the PWM signal 125 to a backlight driving circuit 136 for controlling a backlight unit 137.

The timing controller 123 is a circuit provided on a timing control substrate.

On the other hand, recently, display devices including no timing controller (timing control substrate) have been developed.

FIG. 9 is an exploded perspective view illustrating how a conventional small-sized display device is configured. The small-sized display device, illustrated in FIG. 9, includes a liquid crystal panel 150 and a backlight unit 167. The liquid crystal panel 150 includes one (1) source driver 153 and one (1) gate driver (not illustrated). The gate driver can be monolithically configured on a glass substrate of a display panel. Upon reception of a video signal, the source driver 153 analyzes an image, generates a PWM signal 156 on the basis of a result obtained by analyzing the image, and then supplies the PWM signal 156 to a backlight driving circuit 157. That is, the source driver 153 serves as a timing controller.

CITATION LIST

Patent Literature

Patent Literature 1

Japanese Patent Application Publication, Tokukai, No. 2010-271393 A (Publication Date: Dec. 2, 2010)

SUMMARY OF INVENTION

Technical Problem

Recently, large-sized display devices, which have a large-sized screen, have been required in accordance with, for example, widespread use of digital terrestrial broadcasting. In addition, reduction in thickness of the display devices has been remarkably required.

The small-sized display device, illustrated in FIG. 9, includes no timing controller (timing control substrate), thereby reducing its thickness.

There is a tendency that even a middle-sized or large-sized display device, such as the large-sized display device illustrated in FIG. 8, which (i) has a plurality of display regions and (ii) includes a plurality of source drivers provided for the respective plurality of display regions, reduces its thickness by including no timing controller.

However, in a case where such a middle-sized or large-sized display device, which includes the plurality of source drivers, is realized just by being configured to include a plurality of display devices connected to each other each of which is the small-sized display device illustrated in FIG. 9, the plurality of source drivers cannot share an integration result based on video analysis results. This causes the plurality of source drivers to supply different signals to respective target areas, thereby causing a deterioration in display quality of a liquid crystal panel. That is, according to the above configuration including no timing controller, it is not possible to unify a function of integrating image analysis results of video signals. This makes it impossible to sufficiently perform the aforementioned CABC function.

The present invention was made to address the problem, and an object of the present invention is to provide (i) a display module which (a) reduces its thickness by including no timing controller but including a plurality of source drivers and (b) can carry out satisfactory display and reduce power consumption, (ii) a display device including the display module, (iii) an electronic device including the display device, and (iv) a method of driving the display module.

Solution to Problem

In order to attain the object, a display module of the present invention is configured to include a plurality of source drivers provided for respective regions into which a display region is divided, each of the plurality of source drivers including: an analysis circuit for (i) making an image analysis of a supplied video signal, (ii) supplying a source signal to a corresponding one of the regions, and (iii) outputting an information signal (analysis result information) for controlling a light irradiation section, at least one of the plurality of source drivers being configured to receive a video signal for a corresponding one of the regions but receive no video signal for the region(s) other than the corresponding one of the regions, the display module further including: an output section for outputting one (1) control signal for controlling the light irradiation section, in accordance with the information signals supplied from the respective plurality of source drivers.

According to the configuration, analysis results generated in the respective plurality of source drivers are integrated even in a case where no timing controller is provided. It is therefore possible to provide a middle-sized to large-sized display module which (i) suppresses variation in display among the plurality of source drivers and (ii) carries out satisfactory display.

Further, with the configuration, it is possible to effectively perform a CABC function for controlling the light irradiation section (such as a backlight) which is provided outside of the display module. It is therefore possible to provide a display module capable of reducing power consumption.

Further, according to the configuration, no timing controller (timing control substrate) is necessitated. It is therefore possible to reduce a manufacturing cost of a display module, as compared with a conventional display module including a timing controller (timing control substrate).

The present invention encompasses a display device, including: a display module having the above configuration; and a light irradiation module provided behind the display module, the light irradiation module including a light source.

The present invention also encompasses an electronic device including the display device.

In order to attain the object, a display module driving method of the present invention is configured to be a method of driving a display module which includes (i) a plurality of source drivers provided for respective regions into which a display region is divided and (ii) analysis circuits provided in the respective plurality of source drivers, each of the analysis circuits (i) making an image analysis of a supplied video signal, (ii) supplying a source signal to a corresponding one of the regions and (iii) outputting an information signal (analysis result information) for controlling a light irradiation section, the method including the steps of: supplying, to at least one of the plurality of source drivers, a video signal for a corresponding one of the regions but no video signal for the region(s) other than the corresponding one of the regions; and outputting one (1) control signal for controlling the light irradiation section, in accordance with the information signals supplied from the respective plurality of source drivers.

According to the configuration, image analysis results, which are generated in the respective plurality of source drivers each including the analysis circuit, are integrated. On the basis of an integrated result, the information, which is necessary for the plurality of source drivers to generate the respective source signals, is generated. The information is supplied to the plurality of source drivers.

It is therefore possible to drive a middle-sized to large-sized display module which (i) suppresses variation in display among the plurality of source drivers and (ii) carries out satisfactory display.

Further, with the configuration, it is possible to effectively perform the CABC function. It is therefore possible to drive a display module capable of reducing power consumption.

Further, according to the configuration, no timing controller (timing control substrate) is necessitated. It is therefore possible to reduce a manufacturing cost of a display module, as compared with a conventional display module including a timing controller (timing control substrate).

Advantageous Effects of Invention

According to the present invention, it is possible to provide (i) a display module which (a) includes a plurality of source drivers but includes no timing controller and (b) can carry out satisfactory display and reduce power consumption, (ii) a display device including the display module, and (iii) an electronic device including the display device.

DESCRIPTION OF EMBODIMENTS

The following description will discuss in detail an embodiment of a display device of the present invention.

The embodiment of the display device of the present invention will be described below with reference to FIG. 1.

Figure 1:
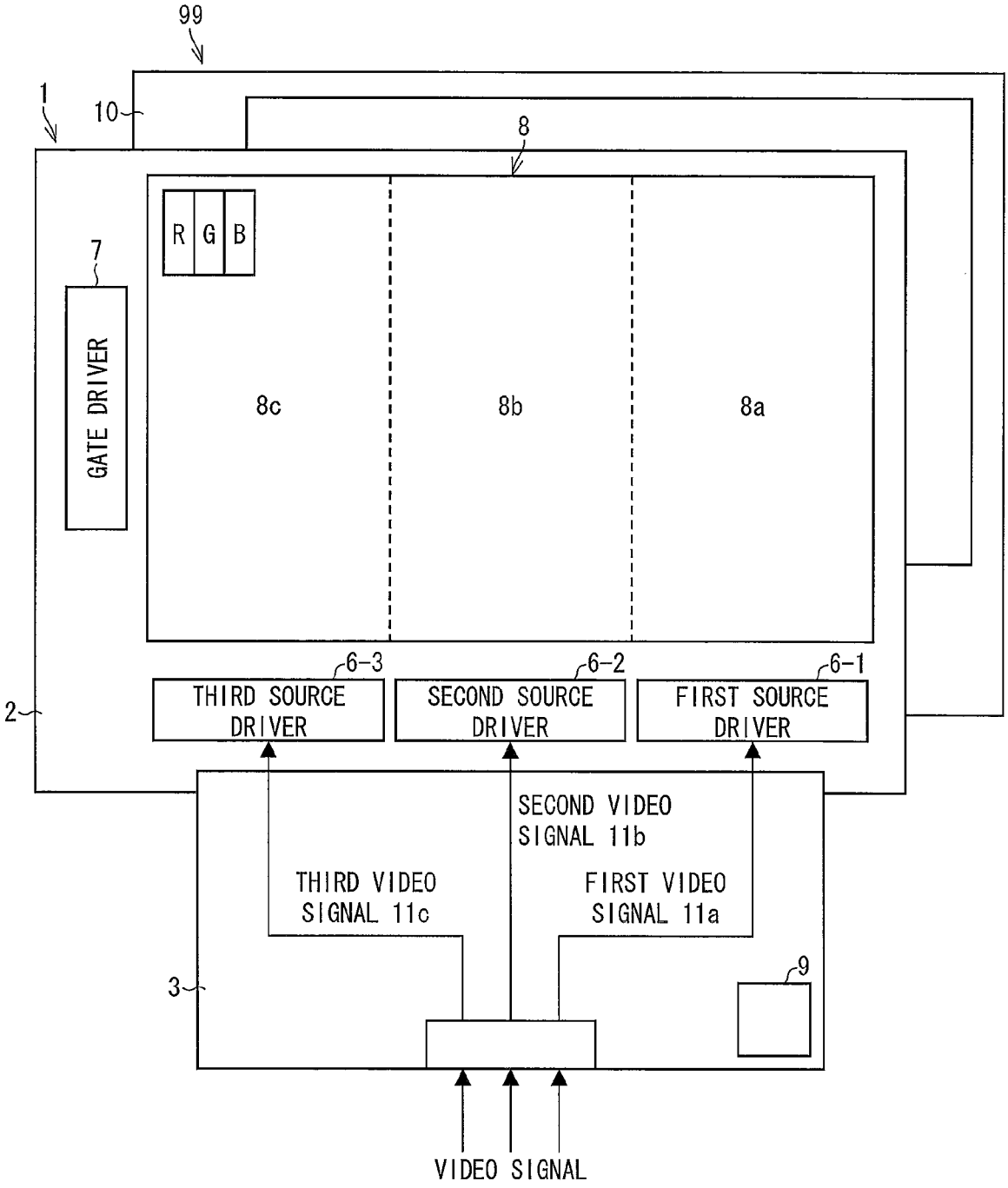
FIG. 1 is an exploded perspective view illustrating a display device in accordance with an embodiment of the present invention.

FIG. 1 is an exploded perspective view illustrating the display device of the present embodiment.

A display device 99 of the present embodiment can be for use in (i) a portable electronic device such as a car navigation system or (ii) an electronic device such as a portable video game terminal, a recorder, a smart phone, or an electronic book reader. The display device 99 includes a display module 1 and a backlight module 10 (a light irradiation section and a light irradiation module) that is provided behind the display module 1 (see FIG. 1).

(Display Module)

The display module 1 includes a display panel 2 and a control substrate 3 (see FIG. 1). The display panel 2 includes a pixel array 8, a gate driver 7, a first source driver 6-1, a second source driver 6-2, and a third source driver 6-3. The control substrate 3 includes (i) a receiver circuit for receiving video signals which are externally supplied and (ii) a backlight light source driving section 9.

Pixel Array

The pixel array 8 is configured so that pixels are arranged in a matrix manner at intersections of a plurality of gate bus lines and a plurality of source bus lines. Each of the pixels is connected to (i) a corresponding one of the plurality of gate bus lines and (ii) a corresponding one of the plurality of source bus lines, which are adjacent to each other.

According to, for example, a liquid crystal display device which carries out color display with use of primary colors of R (red), G (green), and B (blue), one (1) color is expressed by three pixels R, G, and B illustrated in FIG. 1.

A substrate structure, which constitutes the pixel array 8, includes, for example, (i) an active matrix substrate in which pixel electrodes and an alignment film are provided on an electrically insulating substrate, (ii) a counter substrate in which a common electrode and an alignment film are provided on another electrically insulating substrate, and (iii) a liquid crystal layer provided between the active matrix substrate and the counter substrate. A polarizing plate (not illustrated) can be further provided on each of the active matrix substrate and the counter substrate. The pixels are defined by the respective pixel electrodes. The display panel 2 can operate, for example, in VA mode.

Note that the pixel array 8, the gate driver 7, and the first through third source drivers 6-1 through 6-3 are provided on an identical substrate.

Note also that, according to the present embodiment, a display region, which is constituted by the pixel array 8, is divided into a plurality of regions. Specifically, according to the present embodiment, the display region is divided into three regions. Hereinafter, "divided" is not intended to mean that a panel is structurally divided but is intended to mean that a plurality of source drivers are provided for respective sets of source bus lines, into which a plurality of source bus lines, in a display region, are divided (later described).

Hereinafter, it is assumed that the three regions are a first display region 8*a*, a second display region 8*b*, and a third display region 8*c*. The first display region 8*a*, the second display region 8*b*, and the third display region 8*c* are arranged along the gate bus lines in this order, the first display region 8*a* being farthest from the gate driver 7.

Three Source Drivers

The first through third source drivers 6-1 through 6-3 are provided for the first through third display regions 8*a*, 8*b* and 8*c*, respectively. That is, the first source driver 6-1 is provided for the first display region 8*a*, the second source driver 6-2 is provided for the second display region 8*b*, and the third source driver 6-3 is provided for the third display region 8*c*.

Therefore, the source bus lines in the first display region 8*a* are connected to the first source driver 6-1 so that a video signal (data) supplied from the first source driver 6-1 is written via the source bus lines. The source bus lines in the second display region 8*b* are connected to the second source driver 6-2 so that a video signal (data) supplied from the second source driver 6-2 is written via the source bus lines. The source bus lines in the third display region 8*c* are connected to the third source driver 6-3 so that a video signal (data) supplied from the third source driver 6-3 is written via the source bus lines.

A structural feature of the present embodiment resides in the first through third source drivers 6-1 through 6-3.

The first through third source drivers 6-1 through 6-3 directly receive externally supplied video signals for images to be displayed in the respective first through third display regions 8*a*, 8*b* and 8*c* (step of supplying).

Specifically, the first through third source drivers 6-1, through 6-3 receive respective video signals which are externally supplied based on a Point-to-Point system.

Note that the "Point-to-Point system" is intended to mean a system in which video signals for respective display regions are supplied to respective source drivers. That is, according to the present embodiment, video signals are (i) a first video signal 11*a* for the first display region 8*a*, (ii) a second video signal 11*b* for the second display region 8*b*, and (iii) a third video signal 11*c* for the third display region 8*c*. The first through third video signals 11*a* through 11*c* are for the first through third source drivers 6-1 through 6-3, respectively. The first through third source drivers 6-1 through 6-3 receive the first through third video signals 11*a* through 11*c*, respectively. By employing the Point-to-Point system, each of the first through third source drivers 6-1 through 6-3 can receive a corresponding one of the first through third video signals 11*a* through 11*c*, without being affected by the other two source drivers.

According to the present embodiment, as with a general configuration, timing, at which each video signal is supplied to a corresponding one of the first through third source drivers 6-1 through 6-3, is controlled on a set-side (on an output side).

Each of the first through third source drivers 6-1 through 6-3 includes an image analysis circuit (not illustrated) for analyzing an image in response to a corresponding one of supplied video signals.

Note that each of the image analysis circuits generates image analysis result information as analysis result information.

The image analysis result information contains at least one of a PWM (Pulse Width Modulation) signal, duty ratio information, and other information. For example, a configuration can be employed in which duty ratio information is communicated between source drivers, via a serial interface.

However, in a case where a PWM signal is directly communicated between source drivers, the source drivers each should include analog circuits. This causes circuit configurations to be complex, and may cause such communication to be affected by, for example, (i) a variation in circuit configurations and (ii) wire resistances. According to the configuration in which image analysis result information and/or information such as duty ratio information are/is communicated between the source drivers, information is merely communicated between the source drivers. This configuration brings about an effect that loss of signals is hardly caused.

Another structural feature of the present embodiment resides in that (i) a PWM signal to be supplied to the backlight light source driving section 9 (later described) reflects all analysis results, which are obtained in the respective first through third source drivers 6-1 through 6-3 and (ii) gamma (γ) setting information to be applied to the first through third display regions 8*a* through 8*c* is generated by one of the first through third source drivers 6-1 through 6-3 and is then supplied to the others of the first through third source drivers 6-1 through 6-3.

Figure 2:
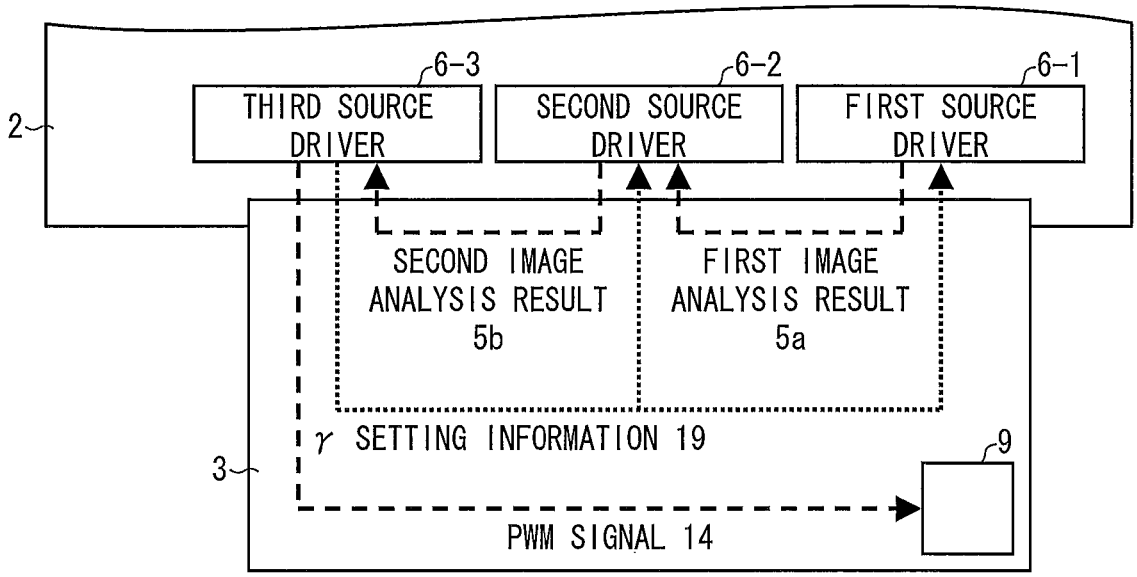
FIG. 2 is a view illustrating how signals are supplied among source drivers which are components of the display device illustrated in FIG. 1.

The following description will discuss, with reference to FIG. 2, processes which are carried out by the respective first through third source drivers 6-1 through 6-3. FIG. 2 is an enlarged view illustrating flows of signals between (i) the respective first through third source drivers 6-1 through 6-3 in the display panel 2 and (ii) a peripheral configuration, illustrated in FIG. 1. Note that, for convenience, FIG. 2 does not illustrate the video signals illustrated in FIG. 1.

First Source Driver 6-1

The first source driver 6-1 includes a circuit (not illustrated) for making an image analysis of a first video signal 11*a* (see FIG. 1) and then generating a first image analysis result 5*a*.

The first image analysis result 5*a* generated by the circuit of the first source driver 6-1 is supplied to the second source driver 6-2.

Second Source Driver 6-2

The second source driver 6-2 includes a circuit for making an image analysis of a second video signal 11*b* (see FIG. 1) and then generating a 2'nd image analysis result.

The second source driver 6-2 further includes a circuit for generating a second image analysis result 5*b* on the basis of the first image analysis result 5*a* and the 2'nd image analysis result.

The second image analysis result 5*b* thus generated is supplied to the third source driver 6-3.

Third Source Driver 6-3

The third source driver 6-3 includes a circuit for making an image analysis of a third video signal 11*c* (see FIG. 1) and then generating a 3'rd image analysis result.

The third source driver 6-3 further includes a circuit for generating a third image analysis result on the basis of the second image analysis result 5*b* and the 3'rd image analysis result.

The third source driver 6-3 further includes a circuit for generating a PWM single 14 on the basis of the third image analysis result.

The third source driver 6-3 then supplies the PWM signal 14 to the backlight light source driving section 9 (step of outputting).

The PWM signal 14, to be supplied to the backlight light source driving section 9, thus reflects the image analysis results of the respective source drivers. It is therefore possible to carry out display without contradiction among the source drivers, even in a case where no timing control substrate is provided.

The third source driver 6-3 further includes a circuit for setting a gamma characteristic on the basis of the third image analysis result. A parameter setting is carried out with respect to the circuit in advance so that the circuit sets an appropriate gamma characteristic in response to a supplied third image analysis result. The gamma characteristic thus set is supplied, as gamma setting information 19, to the first source driver 6-1 and the second source driver 6-2.

Each of the first through third source drivers 6-1 through 6-3 carries out an image process based on the gamma setting information 19 so as to generate a source signal. The gamma setting information 19 is information for generating the source signal.

That is, the gamma setting information 19 is a gamma characteristic which is set on the basis of the third image analysis result which reflects the image analysis results of all the display regions. Since the image processes are carried out with respect to the respective display regions based on the gamma setting information 19, no contradiction is caused among the display regions. It follows that no variation in brightness of images is caused. This allows satisfactory display over the display regions.

Gate Driver

The gate driver 7, illustrated in FIG. 1, selects in sequence a gate bus line so as to control ON/OFF of switching elements in the pixels. This causes (i) a video signal (data), which is supplied to the source bus lines, to be written in corresponding pixels and (ii) the corresponding pixels to keep the data.

Gate driver control signals (generally, GSP/GCK/GOE) for controlling the gate driver 7 are generated by one of the first through third source drivers 6-1 through 6-3. In synchronization with the gate driver control signals, the gate driver 7 selects in sequence a gate bus line so as to control ON/OFF of the switching elements in the pixels. This causes (i) a video signal (data), which is supplied to the source bus lines, to be written in corresponding pixels and (ii) the corresponding pixels to keep the data.

Backlight Light Source Driving Section

Figure 3:
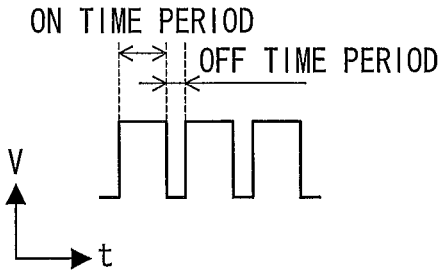
FIG. 3 is a view illustrating a duty ratio in accordance with the embodiment of the present invention.

The backlight light source driving section 9 is provided on the control substrate 3 (see FIG. 1). The backlight light source driving section 9 is configured so as to (i) receive a PWM signal 14 from the third source driver 6-3, (ii) receive a driving voltage from a power supply (not illustrated), and (iii) carry out a duty control with respect to the driving voltage in accordance with the PWM signal 14. Note that the duty control is a conventionally well-known duty control based on which driving of a backlight is carried out in accordance with a PWM signal. FIG. 3 illustrates a duty ratio for the duty control.

Wires of anodes of LEDs in the backlight module 10 and wires of cathodes of the LEDs in the backlight module 10 are extended to the backlight light source driving section 9.

(Backlight Module)

The backlight module 10 is a planar light source device which is, as has been described, provided behind the display module 1. The backlight module 10 includes a light guide plate (not illustrated) and the LEDs (not illustrated). The backlight module 10 has an edge light type (also referred to as "side light type") structure in which the LEDs are provided on a side end part of the light guide plate. Note that the present invention is not limited to such, and therefore the backlight module 10 can have a direct type structure in which the LEDs are provided behind the light guide plate. The edge light type structure is preferable in view of the fact that the edge light type structure can contribute to a reduction in thickness of the display device.

Effect Brought about by the Present Embodiment

According to the present embodiment, the display device, which has the plurality of display regions, includes no timing control substrate. This allows a reduction in thickness of the display device.

Furthermore, the display device of the present embodiment, which includes no timing control substrate, can reduce manufacturing cost, as compared with a conventional display device (display module) which includes a timing control substrate.

According to the present embodiment, the plurality of source drivers analyze images to be displayed in their respective display regions. On the basis of results obtained by analyzing the respective images, a PWM signal, which reflects the results, is generated. This makes it possible to retain a satisfactory display quality in all of the display regions without contradiction among the source drivers, even in a case where no timing control substrate is provided.

According to the present embodiment, each of the plurality of source drivers analyzes only an image to be displayed in a corresponding one of the display regions. Therefore, the burden of each of the source drivers is reduced, as compared with a case where each of the source drivers analyzes an image to be displayed in all of the display regions. This allows power consumption to be reduced, as compared with a case where each of the source drivers carries out an image analysis with respect to a supplied video signal for all of the display regions.

Modification 1

Figure 4:
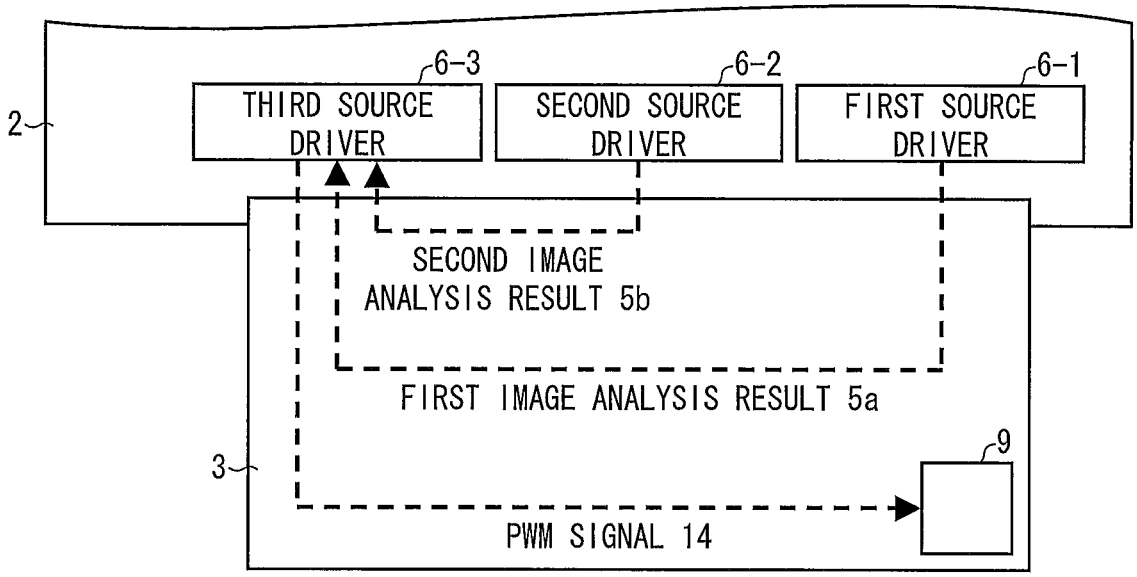
FIG. 4 is a view illustrating a modification of the embodiment of the present invention.

According to the present embodiment, (i) the first image analysis result 5*a*, which is generated by the circuit of the first source driver 6-1, is supplied to the second source driver 6-2, (ii) the second image analysis result 5*b*, which is generated by the circuit of the second source driver 6-2, is supplied to the third source driver 6-3, and then (iii) the PWM signal 14 and the third image analysis result are generated in the third source driver 6-3. That is, the analysis results are supplied from one source driver to another. Note, however, that the present invention is not limited to such, and can therefore employ, for example, a configuration of Modification 1 illustrated in FIG. 4. FIG. 4 corresponds to FIG. 2.

According to the configuration of Modification 1 illustrated in FIG. 4, a third source driver 6-3 receives a first image analysis result 5*a* and a second image analysis result 5*b* from a first source driver 6-1 and a second source driver 6-2, respectively. Therefore, the third source driver 6-3 has two input terminals via which the respective first and second image analysis results 5*a* and 5*b* are supplied.

The third source driver 6-3 of Modification 1 has the input terminals which are larger in number than that of the third source driver 6-3 illustrated in FIG. 2. This causes an increase in chip surface area of the third source driver 6-3 of Modification 1. This ultimately causes a rise in manufacturing cost. On the contrary, as illustrated in FIG. 2, the second source driver 6-2 receives the first image analysis result 5*a*, and the third source driver 6-3 receives the second image analysis result 5*b*. This eliminates the necessity that one (1) source driver has two input terminals.

It is therefore more preferable, in terms of (i) chip surface area and (ii) manufacturing cost, that the present invention employs the configuration illustrated in FIG. 2 than the configuration illustrated in FIG. 4.

Modification 2

Figure 5:
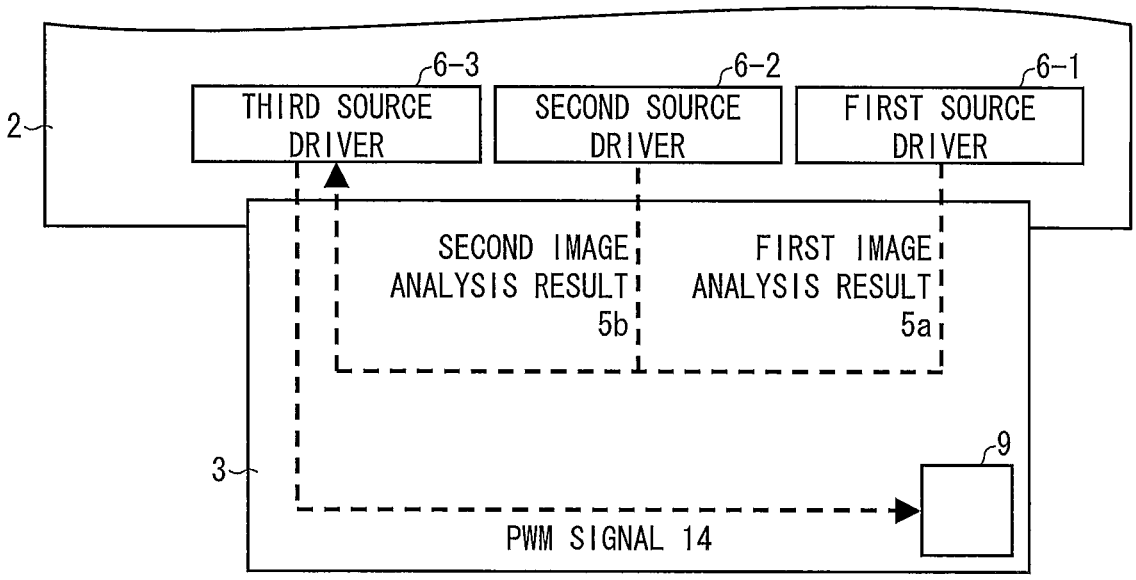
FIG. 5 is a view illustrating another modification of the embodiment of the present invention.

FIG. 5 illustrates Modification 2. FIG. 5 corresponds to FIG. 2.

According to a configuration of Modification 2 illustrated in FIG. 5, a third source driver 6-3 is connected to a wire obtained by connecting a wire of a first source driver 6-1 to a wire of a second source driver 6-2.

The configuration, illustrated in FIG. 5, addresses a problem that the number of terminals is increased in Modification 1 illustrated in FIG. 4.

According to Modification 2 illustrated in FIG. 5, however, it is necessary to alternately supply a first image analysis result 5*a* and a second image analysis result 5*b* to the third source driver 6-3 from the first and second source drivers 6-1 and 6-2, respectively. It is therefore necessary to separately provide a circuit for controlling timings at which the respective first and second image analysis results 5*a* and 5*b* are supplied, which circuit is not required to be provided in the configuration of the present embodiment. This causes a rise in manufacturing cost. On this account, the configuration illustrated in FIG. 2 is more preferable than that illustrated in FIG. 5 in terms of manufacturing cost.

Modification 3

Figure 6:
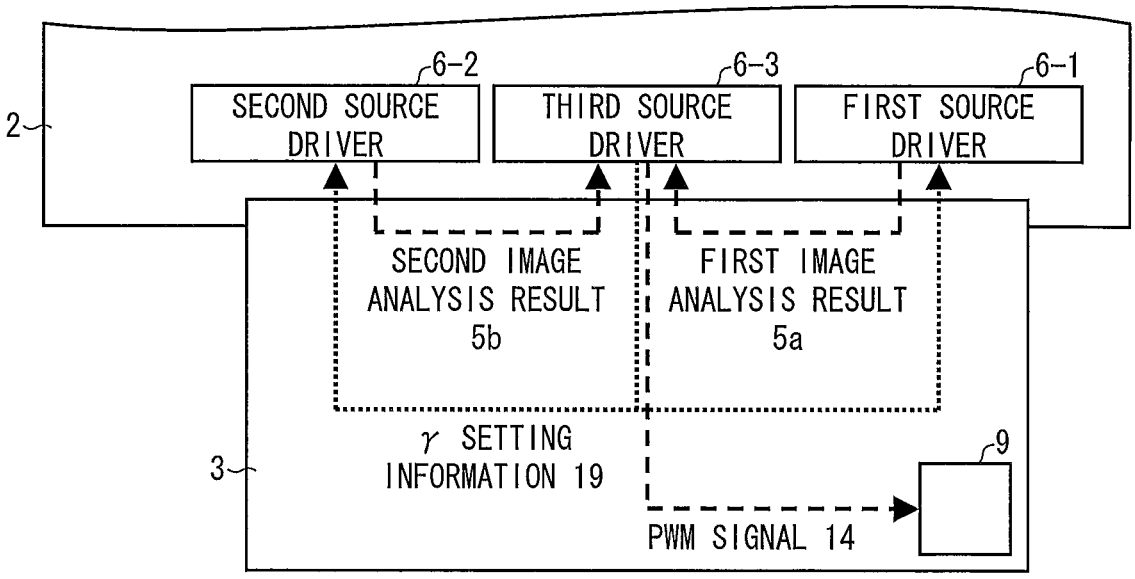
FIG. 6 is a view illustrating yet another modification of the embodiment of the present invention.
Figure 7:
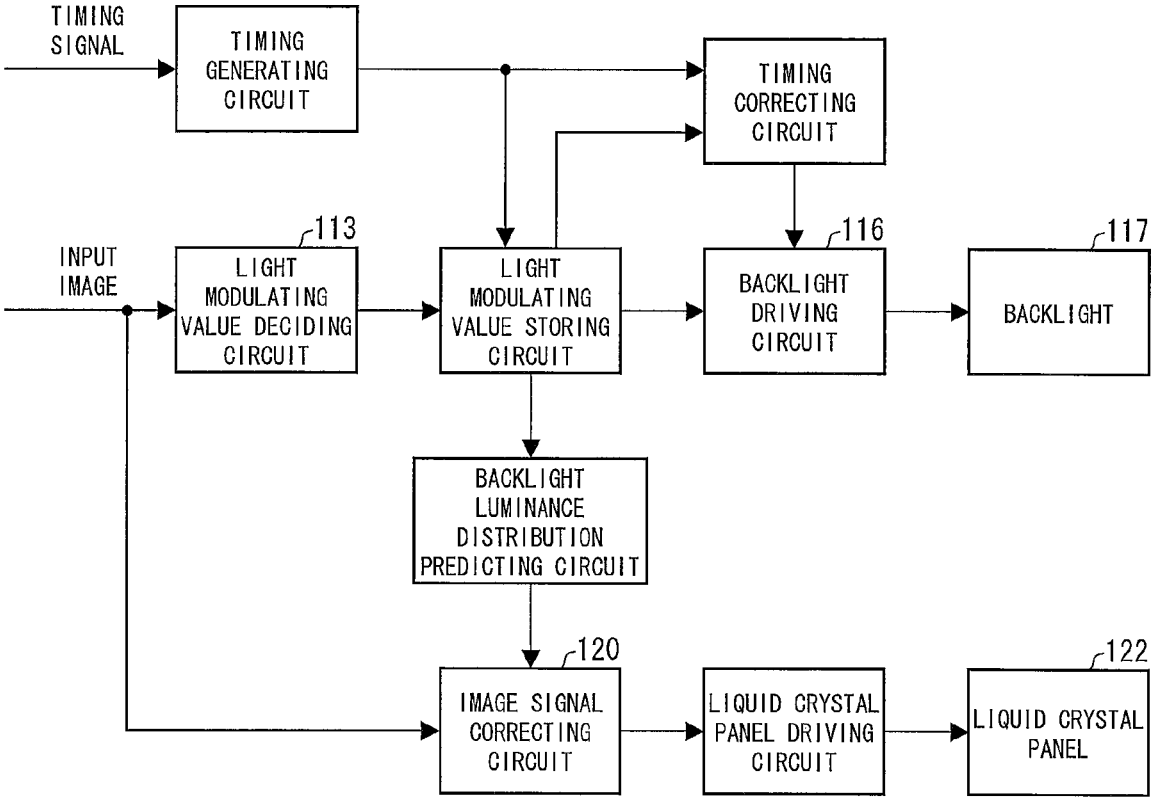
FIG. 7 PRIOR ART
FIG. 7 is a view illustrating a conventional technique.
Figure 8:
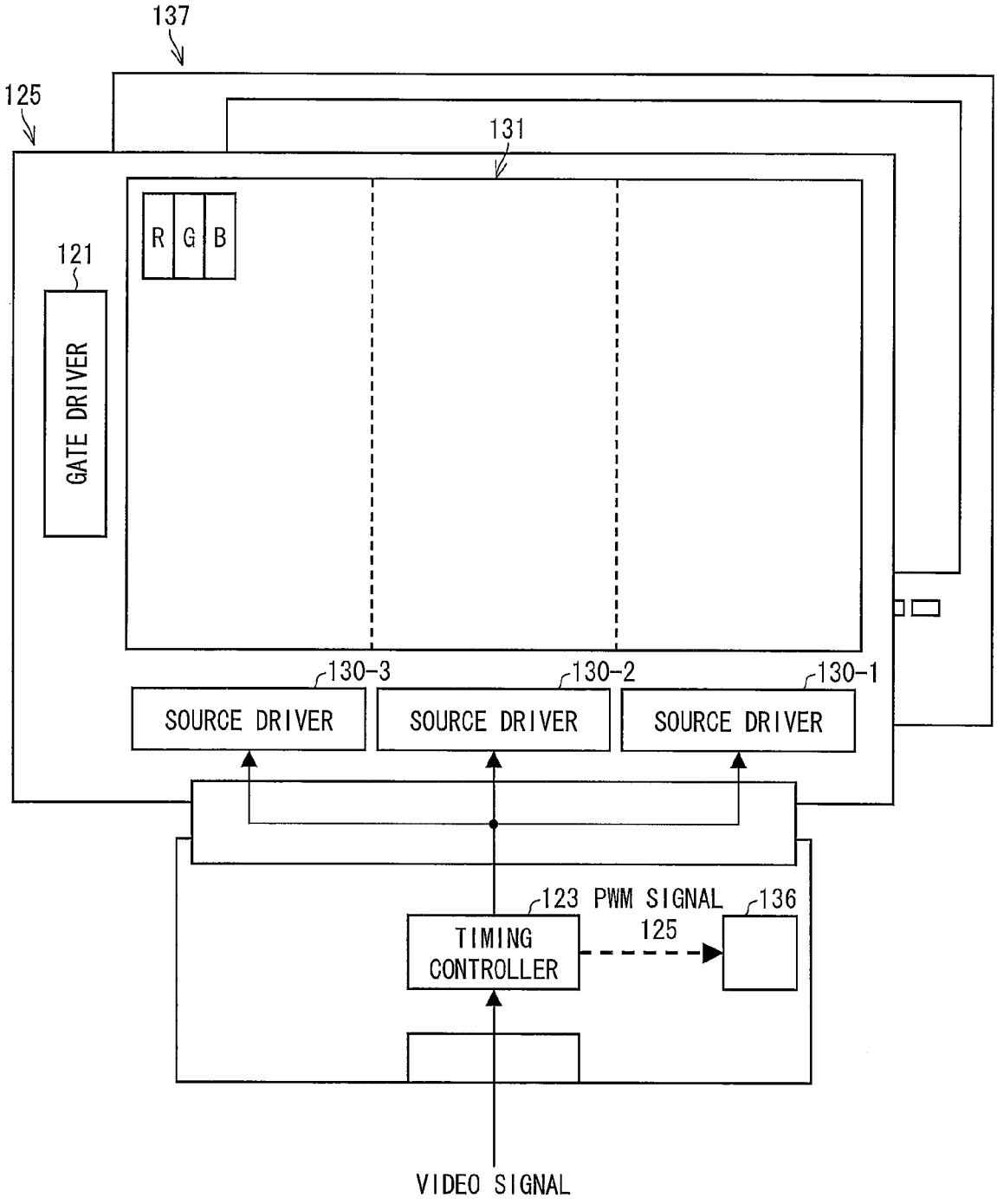
FIG. 8 PRIOR ART
FIG. 8 is a view illustrating another conventional technique.
Figure 9:
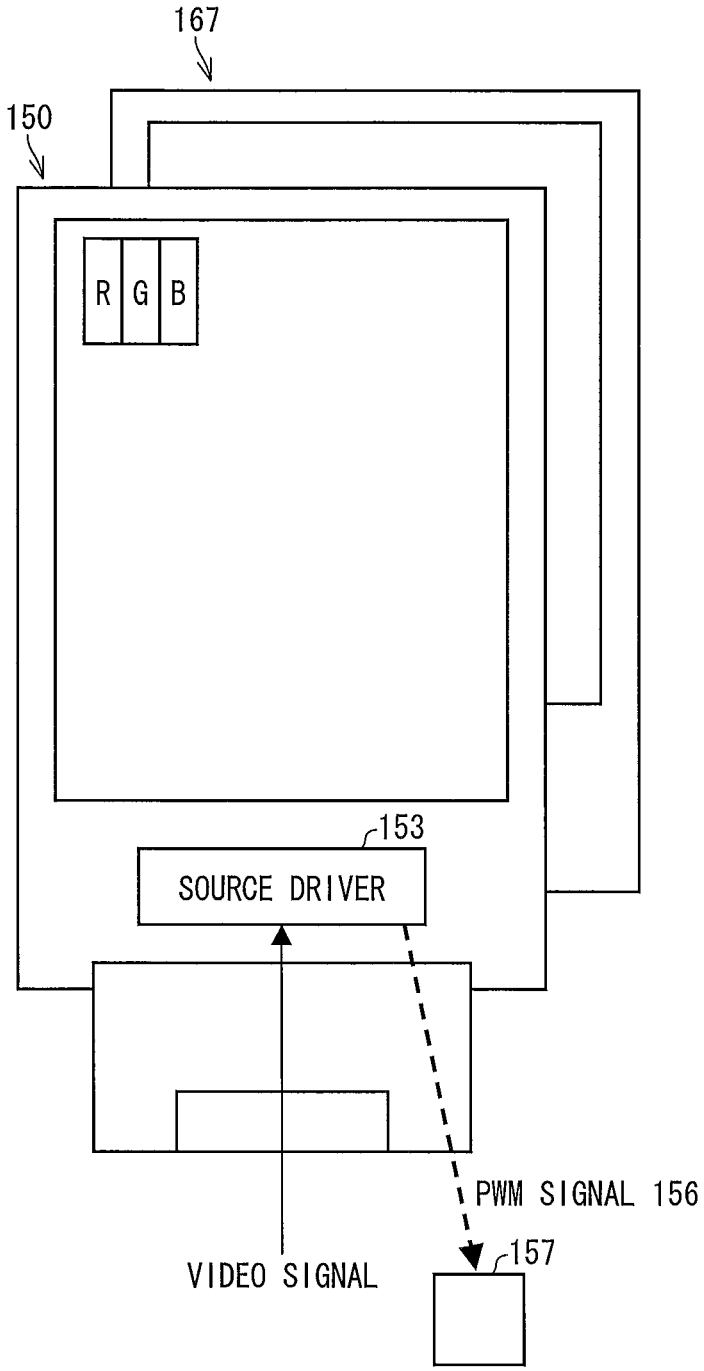
FIG. 9 PRIOR ART
FIG. 9 is a view illustrating yet another conventional technique.

FIG. 6 illustrates Modification 3. FIG. 6 corresponds to FIG. 2.

According to the present embodiment, the third source driver 6-3 for supplying gamma setting information 19 and a PWM single 14 is located at an end of the first through third source drivers 6-1 through 6-3 (see FIG. 2). Note, however, that the present embodiment is not limited to such.

According to a configuration of Modification 3 illustrated in FIG. 6, a third source driver 6-3 for supplying gamma setting information 19 and a PWM single 14 is located between a first source driver 6-1 and a second source driver 6-2.

According to the configuration of Modification 3, it is possible to shorten a wire which is used to supply gamma setting information 19 from the third source driver 6-3 to the first and second source drivers 6-1 and 6-2, as compared with a case where the third source driver 6-3 is provided at an end. According to the configuration of Modification 3, particularly in a case where the gamma setting information 19 is an analog voltage signal, it is possible to minimize a voltage drop across wire resistance.

The configuration of Modification 3 means, in other words, that the third source driver 6-3 for supplying gamma setting information 19 is provided in the middle of a row of the source drivers. According to Modification 3, since such three source drivers are provided, one of the three source drivers, which one is located in the middle, servers as the third source driver 6-3. Note, however, that, in a case where a display region is divided into regions other than three regions, a source driver, which is provided for one of the regions which is located in the middle (center), serves as the third source driver 6-3. The configuration of Modification 3 is effective particularly for a display module including a large-sized display panel.

Modification 4

According to the present embodiment, video signals to be supplied to the source drivers are for the respective display regions. Note, however, that the present invention is not limited to such. An alternative configuration can be employed in which one or some of the plurality of source drivers receive(s) a video signal for all of the display regions.

A source driver, to which a video signal for a whole display region is supplied, can carry out an image process for the whole display region in response to the video signal.

In this case, it is possible to generate a gamma characteristic (gamma setting information 19) without using image process results which are supplied from the other source drivers.

Note that the present invention is not limited to the description of the embodiment and Modifications above, and can therefore be modified by a skilled person in the art within the scope of the claims. Namely, a new embodiment is obtained by combining technical means modified as appropriate within the scope of the claims. That is, the embodiment and specific examples described in the Detailed Description of Invention serve solely to illustrate the technical details of the present invention, which should not be narrowly interpreted within the limits of such embodiments and specific examples, but rather may be applied in many variations within the spirit of the present invention, provided that such variations do not exceed the scope of the patent claims set forth below.

SUMMARY OF THE PRESENT INVENTION

A display module of the present invention is configured to include a plurality of source drivers provided for respective regions into which a display region is divided, each of the plurality of source drivers including: an analysis circuit for (i) making an image analysis of a supplied video signal, (ii) supplying a source signal to a corresponding one of the regions, and (iii) outputting an information signal (analysis result information) for controlling a light irradiation section, at least one of the plurality of source drivers being configured to receive a video signal for a corresponding one of the regions but receive no video signal for the region(s) other than the corresponding one of the regions, the display module further including: an output section for outputting one (1) control signal for controlling the light irradiation section, in accordance with the information signals supplied from the respective plurality of source drivers.

According to the configuration, analysis results generated in the respective plurality of source drivers are integrated even in a case where no timing controller is provided. It is therefore possible to provide a middle-sized to large-sized display module which (i) suppresses variation in display among the plurality of source drivers and (ii) carries out satisfactory display.

Further, with the configuration, it is possible to effectively perform a CABC function for controlling the light irradiation section (such as a backlight) which is provided outside of the display module. It is therefore possible to provide a display module capable of reducing power consumption.

Further, according to the configuration, no timing controller (timing control substrate) is necessitated. It is therefore possible to reduce a manufacturing cost of a display module, as compared with a conventional display module including a timing controller (timing control substrate).

It is preferable to further configure the display module of the present invention such that some of the plurality of source drivers are configured to (i) generate information which is necessary for the plurality of source drivers to generate respective source signals and (ii) supply the information to remaining one(s) of the plurality of source drivers, and the plurality of source drivers are configured to supply, from the respective analysis circuits, the respective source signals generated on the basis of the information.

According to the configuration, image analysis results, which are generated in the respective plurality of source drivers each including the analysis circuit, are integrated. On the basis of the integrated result, the information, which is necessary for the plurality of source drivers to generate the respective source signals, is generated. The information is supplied to the plurality of source drivers.

It is therefore possible to provide a middle-sized to large-sized display module which (i) suppresses variation in display among the plurality of source drivers and (ii) carries out satisfactory display.

Further, with the configuration, it is possible to effectively perform the CABC function. It is therefore possible to provide a display module capable of reducing power consumption.

Further, according to the configuration, no timing controller (timing control substrate) is necessitated. It is therefore possible to reduce a manufacturing cost of a display module, as compared with a conventional display module including a timing controller (timing control substrate).

It is preferable to further configure the display module of the present invention such that the plurality of source drivers are arranged along a side of the display region, and the some of the plurality of source drivers are located in the middle of a row of the plurality of source drivers.

According to the configuration, it is possible to shorten a wire between the source drivers, as compared with a case where the some of the plurality of source drivers are located at an end of the plurality of source drivers. This makes it possible to prevent delay of signal transmission.

According to the configuration, it is further possible to shorten a transmission time period which is required for an analysis result to be supplied, as compared with a configuration in which analysis results are supplied from one source driver to another source driver.

It is preferable to further configure the display module of the present invention such that the output section is some of the plurality of source drivers.

According to the configuration, it is not necessary to provide, separately from the source drivers, a configuration (circuit) for generating one (1) control signal for controlling the light irradiation section. This allows a reduction in manufacturing cost, as compared with a configuration which requires separate provision of the circuit.

It is preferable to further configure the display module of the present invention such that the output section is one of the plurality of source drivers, remaining ones other than the one of the plurality of source drivers are at least two source drivers, a first source driver of the at least two source drivers supplies, to a second source driver of the at least two source drivers, a first analysis result generated by one of the analysis circuits, which one is included in the first source driver, and the second source driver supplies, to a third source driver of the at least two source drivers or to the output section, a second analysis result generated by integrating the first analysis result with an analysis result that is generated by one of the analysis circuits, which one is included in the second source driver.

According to the configuration, the analysis results are supplied from one source driver to another source driver.

This makes it possible to reduce the number of input terminals of one (1) source driver, as compared with a configuration in which one source driver has input terminals via which the respective other source drivers supply analysis results to the one source driver.

It is therefore possible to reduce a chip surface area which is required for an input terminal to be provided. This ultimately allows (i) a reduction in size of a chip and (ii) a reduction in manufacturing cost, which is accompanied by the size reduction.

It is preferable to further configure the display module of the present invention such that the output section is one of the plurality of source drivers, and the one of the plurality of source drivers is configured to (i) generate information which is necessary for the plurality of source drivers to generate respective source signals and (ii) supply the information to remaining one(s) of the plurality of source drivers.

According to the configuration, the plurality of source drivers can generate the respective source signals on the basis of an image analysis result which reflects all of the analysis results generated in the respective plurality of source drivers. It is therefore possible to effectively perform the CABC function without deteriorating display quality.

It is preferable to further configure the display module of the present invention such that each of the plurality of source drivers is configured to receive a video signal for a corresponding one of the regions but receive no video signal for the region(s) other than the corresponding one of the regions.

According to the configuration, the each of the plurality of source drivers is configured to receive a video signal for the corresponding one of the regions. It is therefore possible to make a logic size of the each of the plurality of source drivers appropriate, as compared with a configuration in which the each of the plurality of source drivers receives a video signal for the whole display region. This makes it possible to attain a reduction in size and power consumption of the each of the plurality of source drivers.

The present invention encompasses a display device, including: a display module having the above configuration; and a light irradiation module provided behind the display module, the light irradiation module including a light source.

The present invention also encompasses an electronic device including the display device.

In order to attain the object, a display module driving method of the present invention is configured to be a method of driving a display module which includes (i) a plurality of source drivers provided for respective regions into which a display region is divided and (ii) analysis circuits provided in the respective plurality of source drivers, each of the analysis circuits (i) making an image analysis of a supplied video signal, (ii) supplying a source signal to a corresponding one of the regions and (iii) outputting an information signal for controlling a light irradiation section, the method including the steps of: supplying, to at least one of the plurality of source drivers, a video signal for a corresponding one of the regions but no video signal for the region(s) other than the corresponding one of the regions; and outputting one (1) control signal for controlling the light irradiation section, in accordance with the information signals supplied from the respective plurality of source drivers.

According to the configuration, image analysis results, which are generated in the respective plurality of source drivers each including the analysis circuit, are integrated. On the basis of the integrated result, the information, which is necessary for the plurality of source drivers to generate the respective source signals, is generated. The information is supplied to the plurality of source drivers.

It is therefore possible to drive a middle-sized to large-sized display module which (i) suppresses variation in display among the plurality of source drivers and (ii) carries out satisfactory display.

Further, with the configuration, it is possible to effectively perform the CABC function. It is therefore possible to drive a display module capable of reducing power consumption.

Further, according to the configuration, no timing controller (timing control substrate) is necessitated. It is therefore possible to reduce a manufacturing cost of a display module, as compared with a conventional display module including a timing controller (timing control substrate).

INDUSTRIAL APPLICABILITY

The present invention is applicable to a display device, such as a 10 to 13 inch display device, which includes a display panel having a plurality of display regions for which respective source drivers are provided.

REFERENCE SIGNS LIST

1: display module
2, 2', and 2": display panel
3: control substrate
5*a*: first image analysis result
5*b*: second image analysis result
6-1: first source driver
6-2: second source driver
6-3: third source driver (output section)
7: gate driver
8: pixel array
8*a*: first display region (divided region)
8*b*: second display region (divided region)
8*c*: third display region (divided region)
9: backlight light source driving section
10: backlight module (light irradiation section, light irradiation module)
11*a*: first video signal
11*b*: second video signal
11*c*: third video signal
14: PWM signal
19: gamma setting information
99: display device

The invention claimed is:

1. A display device, comprising:

a display including n source drivers provided for respective ones of n regions into which a display region is divided, n being a natural number equal to 3 or more; and a backlight provided behind the display and including a light source, wherein each of the n source drivers includes an analysis circuit that performs an image analysis of only a video signal of a corresponding one of the n regions to generate an analysis result, that supplies a source signal to the corresponding one of the n regions, and that outputs an information signal which controls the backlight, the n source drivers include a first source driver through an n-th source driver, the information signal generated by the analysis circuit of the first source driver is an analysis result generated by the analysis circuit of the first source driver, the first source driver receives the video signal of the region corresponding to the first source driver but does not receive any video signal for any of the regions corresponding to a second source driver through the n-th source driver, the information signal generated by the analysis circuit of a k-th source driver being supplied to a k+1-th source driver, k being any natural number equal to 1 or more and n−1 or less, the k+1-th source driver integrating the information signal generated by the analysis circuit of the k-th source driver with the analysis result generated by the analysis circuit of the k+1-th source driver so as to generate the information signal, the n-th source driver outputs one control signal that controls the backlight in accordance with the information signal generated by the analysis circuit of the n-th source driver.

2. The display device as set forth in claim 1, wherein:

the n-th source driver generates information which is necessary for the n source drivers to generate respective source signals, and supplies the information signal to the first source drivers through an n−1-th source driver.

3. A display device, comprising:

a display including of n source drivers provided for respective ones of n regions into which a display region is divided, n being a natural number equal to 3 or more; and a backlight provided behind the display, the backlight including a light source, each of the n source drivers includes an analysis circuit that performs an image analysis of only a video signal of a corresponding one of the n regions to generate an analysis result, supplies a source signal to the corresponding one of the n regions, and outputs an information signal that controls the backlight, the n source drivers including a first source driver through an n-th source driver, the information signals generated by the analysis circuits of the first source driver through the n−1-th source driver being the analysis results generated by the respective analysis circuits of the first source driver through n−1-th source driver, the first source driver receives the video signal for the region corresponding to the first source driver, but does not receive any video signal for any of the n regions corresponding to a second source driver through the n-th source driver, the information signal generated by the analysis circuit of a k-th source driver being supplied to the n-th source driver, k being any natural number equal to 1 or more and n−1 or less, the n-th source driver integrating the information signals generated by the analysis circuits of the first source driver through the n−1-th source driver with the analysis result generated by the analysis circuit of the n-th source driver so as to generate the information signal, the n-th source driver outputs one control signal that controls the backlight in accordance with the information signal generated by the analysis circuit of the n-th source driver.

4. The display device as set forth in claim 3, wherein:

the n-th source driver generates information which is necessary for the n source drivers to generate respective source signals and supplies the information signal to the first source driver through the n-th source driver.

5. The display device as set forth in claim 1, wherein:

each of the n source drivers receive the video signal for the corresponding one of the n regions, but do not receive any video signal for any other ones of the n regions.

6. A method of driving a display device, the display device including:

a display which includes n source drivers provided to respective ones of n regions into which a display region is divided, n being a natural number equal to 3 or more; and a backlight provided behind the display and including a light source, each of the n source drivers includes an analysis circuit that performs an image analysis of only a video signal of a corresponding one of the n regions to generate an analysis result, that supplies a source signal to a corresponding one of the n regions, and that outputs an information signal that controls the backlight, the n source drivers including a first source driver through an n-th source driver, the information signal generated by the analysis circuit of the first source driver is the analysis result generated by the analysis circuit of the first source driver, the method comprises the steps of:

the first source driver receiving the video signal for the region corresponding to the first source driver but not receiving any video signal for any of the n regions corresponding to a second source driver through the n-th source driver;

outputting, the information signals generated by the analysis circuit of a k-th source driver to a k+1-th source driver, k being any natural number equal to 1 or more and n−1 or less;

the k+1-th source driver integrating the information signals generated by the analysis circuits of the k-th source driver with the analysis result generated by the analysis circuit of the k-th source driver so as to generate the information signal; and the n-th source driver outputting one control signal that controls the backlight in accordance with the information signal generated by the analysis circuit of the n-th source driver.

7. The display device as set forth in claim 3, wherein:

the n source drivers are arranged along a side of the display region, and the n-th source driver is located in a middle of a row of the n source drivers.

8. The display device as set forth in claim 3, wherein the information signal outputted by the analysis circuit of the k-th source driver and the information signal outputted by the analysis circuit of an I-th source driver are supplied to the analysis circuit of the n-th source driver at different timings, and I is any natural number equal to 1 or more and n−1 or less, I being different from k.

9. The display device as set forth in claim 3, wherein:

each of the n source drivers receive the video signal for the corresponding one of the n regions, but do not receive any video signal for any other ones of the n regions.

10. A method of driving a display device, the display device including:

a display which includes n source drivers provided to respective ones of n regions into which a display region is divided, n being a natural number equal to 3 or more; and a backlight provided behind the display and including a light source, each of the n source drivers includes an analysis circuit that performs an image analysis of only a video signal of a corresponding one of the n regions to generate an analysis result, that supplies a source signal to a corresponding one of the n regions, and that outputs an information signal that controls the backlight, the n source drivers including a first source driver through an n-th source driver, the information signals generated by the analysis circuits of the first source driver through an n−1-th source driver is the analysis results generated by the respective analysis circuits of the first source driver through the n−1-th source driver, the method comprises the steps of:

the first source driver receiving the video signal for the region corresponding to the first source driver but not receiving any video signal for any of the n regions corresponding to a second source driver through the n-th source driver;

outputting the information signal generated by the analysis circuit of a k-th source driver to the n-th source driver, k being any natural number equal to 1 or more and n−1 or less;

the n-th source driver integrating the information signals generated by the analysis circuits of the first source driver through n−1-th source driver with the analysis result generated by the analysis circuit of the n-th source driver so as to generate the information signal; and the n-th source driver outputting one control signal that controls the backlight in accordance with the information signal generated by the analysis circuit of the n-th source driver.

* * * * *